US012419402B2

(12) United States Patent
Sze

(10) Patent No.: US 12,419,402 B2
(45) Date of Patent: Sep. 23, 2025

(54) HAIR FASTENERS

(71) Applicant: Tung Hing Plastic Manufactory Ltd., Hong Kong (HK)

(72) Inventor: Ka Chuen Sze, Hong Kong (HK)

(73) Assignee: Tung Hing Plastic Manufactory Limited, Hong Kong (HK)

( * ) Notice: Subject to any disclaimer, the term of this patent is extended or adjusted under 35 U.S.C. 154(b) by 602 days.

(21) Appl. No.: 17/808,544

(22) Filed: Jun. 24, 2022

(65) Prior Publication Data

US 2023/0413971 A1 Dec. 28, 2023

(51) Int. Cl.
*A45D 8/20* (2006.01)

(52) U.S. Cl.
CPC ..... *A45D 8/20* (2013.01)

(58) Field of Classification Search
CPC ... A45D 8/20; A45D 8/22; A45D 8/24; A45D 2/42; A45D 6/145; A45D 6/14
USPC ..... 132/277
See application file for complete search history.

(56) References Cited

U.S. PATENT DOCUMENTS

| | | | | | |
|---|---|---|---|---|---|
| 2,049,773 | A * | 8/1936 | Herschensohn | A45D 2/42 | 132/135 |
| 5,520,201 | A * | 5/1996 | Hart | A45D 8/34 | 132/273 |
| 5,787,905 | A * | 8/1998 | Yasuda | A45D 8/20 | 132/277 |
| 6,026,827 | A * | 2/2000 | Revais | A45D 8/20 | 132/133 |
| 6,189,544 | B1 * | 2/2001 | Potut | A45D 8/20 | 132/277 |
| 9,232,841 | B1 * | 1/2016 | Hsu | A45D 8/20 | |
| D831,273 | S * | 10/2018 | Sze | D28/40 | |
| D918,473 | S * | 5/2021 | Xiao | D28/40 | |
| D956,353 | S * | 6/2022 | Liu | D28/40 | |
| 2012/0080048 | A1 | 4/2012 | Chen | | |
| 2020/0288837 | A1 | 9/2020 | Tu | | |
| 2023/0232925 | A1 * | 7/2023 | Hsu | C08L 67/04 | 132/277 |

FOREIGN PATENT DOCUMENTS

| | | | |
|---|---|---|---|
| AU | 2018205099 | A1 | 1/2020 |
| GB | 2326591 | A | 12/1998 |
| GB | 2623185 | A | 4/2024 |
| KR | 2020034802 | | 2/2004 |

* cited by examiner

*Primary Examiner* — Tatiana L Nobrega
(74) *Attorney, Agent, or Firm* — Melvin Li

(57) ABSTRACT

The present invention is concerned with a hair fastener in the form of a hair claw. The hair fastener has a first claw member hingedly and pivotably connected to a second claw member. The first claw member and the second claw member define a cavity therebetween for housing a log of hair in use. The first claw member and the second claw member are provided with a plurality of first prongs and a plurality of fifth prongs which together define a first, outer, prong layer, a plurality of third and fourth prong which together define a second, middle, prong layer, and a plurality of second and sixth prongs which together define a third, inner, prong layer.

9 Claims, 20 Drawing Sheets

2
p
r
X
Y
Z
Y'
Z'
n
m
s m
n
s
Z
Y
X
Z'
Y'
X'
r
p

HAIR FASTENERS

FIELD OF THE INVENTION

The present invention is concerned with a hair fastener and in particular a hair claw.

BACKGROUND OF THE INVENTION

There are a variety of hair fasteners in the market to suit different needs of a user. One particular type of hair fasteners is known as hair claw. Typically, hair claws are used to manage a larger log or a mass of hair.

While hair claws are popular because they are easy to use and can handle a larger amount of hair, users often find that conventional hair claws are not able to secure hair tightly for a long period of time. Hair fastened by a conventional hair claw tended to shift in position relative to the hair claw and as such the hair claw would then lose its grip. In other words, a user after having secured the hair would often find that the hair would become loosen easily. It follows that s/he would then have to remove the hair claw, and then re-secure and re-clip, repeatedly. This is cumbersome and frustrating.

There have been proposals to address this problem with different ways. However, some of these proposals are complicated and not feasible, for example, in a manufacturing sense.

The present invention seeks to address the above problems, or at least to provide an alternative to the public.

SUMMARY OF THE INVENTION

According to a first aspect of the present invention, there is provided a hair fastener in the form of a hair claw, comprising a first claw member and a second claw member hingedly and pivotably connected to the first claw member, wherein:

- the first claw member and the second claw member define a cavity therebetween for housing a log of hair in use,
- the first claw member includes at least one first finger and one second finger,
- the first finger includes a first prong extending from a distal end thereof and a second prong extending from a mid-portion thereof,
- the second finger includes a third prong extending from a distal end thereof with the third prong,
- the second claw member includes at least one third finger and one fourth finger,
- the third finger includes a fourth prong extending from a distal end thereof,
- the fourth finger includes a fifth prong extending from a distal end thereof and a sixth prong extending from a mid-portion thereof, and
- the first and fifth prongs are longer than the third and fourth prongs, and
- the first and fifth prongs are longer than the second and sixth prongs.

Preferably, the first and fifth prongs may be of a first length, the second and sixth prongs may be of a second length, and the third and fourth prongs may be of a third length, and the first, second and third lengths are different. A hair fastener as claimed in claim 1, wherein the third and fifth prongs are longer than the second and sixth prongs.

Suitably, the first, second and third prongs are pointing towards the second claw member, and the fourth, fifth and sixth prongs are pointing towards to the first claw member.

Advantageously, the fourth prong may be positioned between the first and second prongs, and the third prong may be positioned between the fifth and sixth prongs.

In an embodiment, the hair fastener may comprise a plurality of first prongs and a plurality of fifth prongs, with the first and firth prongs arranged in a cooperating and complementary manner. The first and fifth prongs define a first, outer, prong layer, and the first and fifth prongs and a hinge together may define a cavity therebetween for accommodating a log of hair in use.

In one embodiment, the hair fastener may comprise a plurality of third and fourth prongs, with the third and fourth prongs arranged in a cooperating and complementary manner. The third and fourth prongs may define a second, middle, prong layer, and the third prong may be positioned between the fifth and sixth prongs, and the fourth prong may be positioned between the first and second prongs, for further securing and penetrating the log of hair in use.

In another embodiment, the hair fastener may comprise a plurality of second and sixth prongs, with the second and sixth prongs arranged in a cooperating and complementary manner. The second and sixth prongs may define a third, inner, prong layer, and the second prong may be positioned between the fourth prong and the hinge, and the sixth prong may be positioned between the third prong and the hinge, for further securing and penetrating the log of hair in use.

Preferably, the first and second prongs may extend from the first finger, and the fifth and sixth prongs may extend from the fourth finger, in a diverging configuration.

Suitably, the hair fastener may comprise a torsional spring and a pin defining an axis about which the first claw member and the second claw member pivot, wherein:

- the axis may define a transverse plane,
- the first and fifth prongs may angle away from the hinge with respect to the transverse plane,
- the third and fourth prongs may be arranged perpendicularly to the transverse plane, and
- the second and sixth prongs may angle towards the hinge with respect to the transverse plane.

According to a second aspect of the present invention, there is provided a hair fastener in the form of a hair claw, comprising a first claw member hingedly and pivotably connected to a second claw member, wherein:

- the first claw member and the second claw member define a cavity therebetween for housing a log of hair in use,
- the first claw member and the second claw member are provided with a plurality of first prongs and a plurality of fifth prongs which together define a first, outer, prong layer, a plurality of third and fourth prong which together define a second, middle, prong layer, and a plurality of second and sixth prongs which together define a third, inner, prong layer,
- the first and fifth prongs are of a first length, the third and fourth prongs are of the second length, and the second and sixth prongs are of a third length,
- the first, second, and third prongs from the first claw member point towards the second claw member, and the fourth, fifth and sixth prongs from the second claw member point towards the first claw member.

Preferably, the first and fifth prongs may be arranged in a cooperating and complementary manner. The first and fifth prongs and a hinge together may define a cavity therebetween for surrounding and accommodating a log of hair in use.

Suitably, the third and fourth prongs may be arranged in a cooperating and complementary manner. The third prong may be positioned between the fifth and sixth prongs, the fourth prong may be positioned between first and second prongs, and the third and fourth prongs may be positioned to penetrate and further secure the log of hair in use.

Advantageously, the second and sixth prongs may be arranged in a cooperating and complementary manner. The second prong may be positioned between the first prong and the hinge, the sixth prong may be positioned between the fifth prong and the hinge, and the second and sixth prongs may be positioned to penetrate and further secure the log of hair in use.

BRIEF DESCRIPTION OF THE DRAWINGS

Some embodiments of the present invention will now be explained, with reference to the accompanied drawings, in which.

DETAILED DESCRIPTION OF THE INVENTION

The present invention is concerned with a hair fastener, and is illustrated and explained by way of examples below.

A first embodiment of a hair fastener is shown in FIGS. 1-17. The hair fastener, generally designated 2, is in the form of a hair claw.

Figure 7:
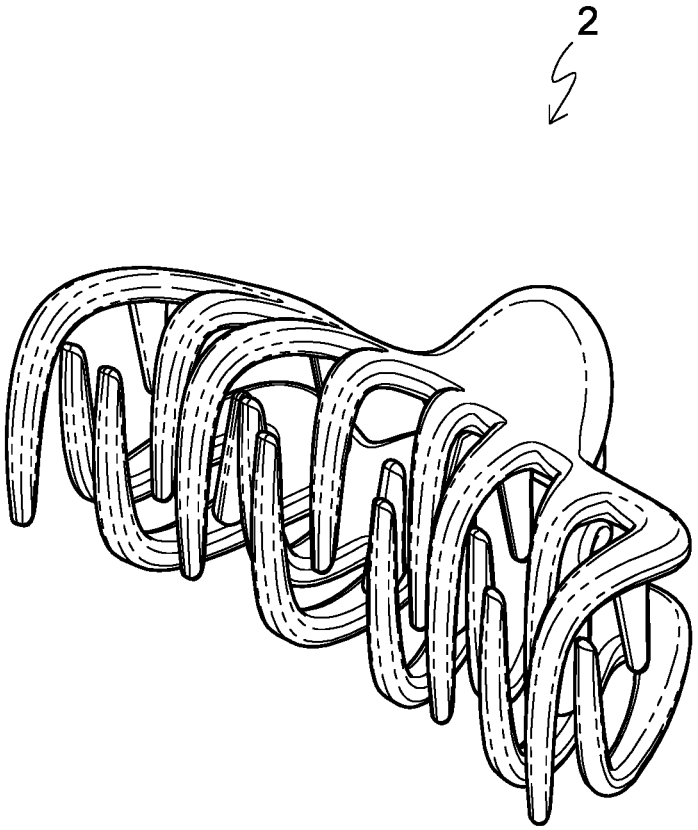
FIG. 7 is a perspective view of the hair fastener of FIG. 1.

FIGS. 1-6 are six orthogonal views of the hair fastener 2. FIG. 7 is a perspective view of the hair fastener 2. All FIGS. 1-7 show the hair fastener 2 in a closed, or default configuration.

Figure 8:
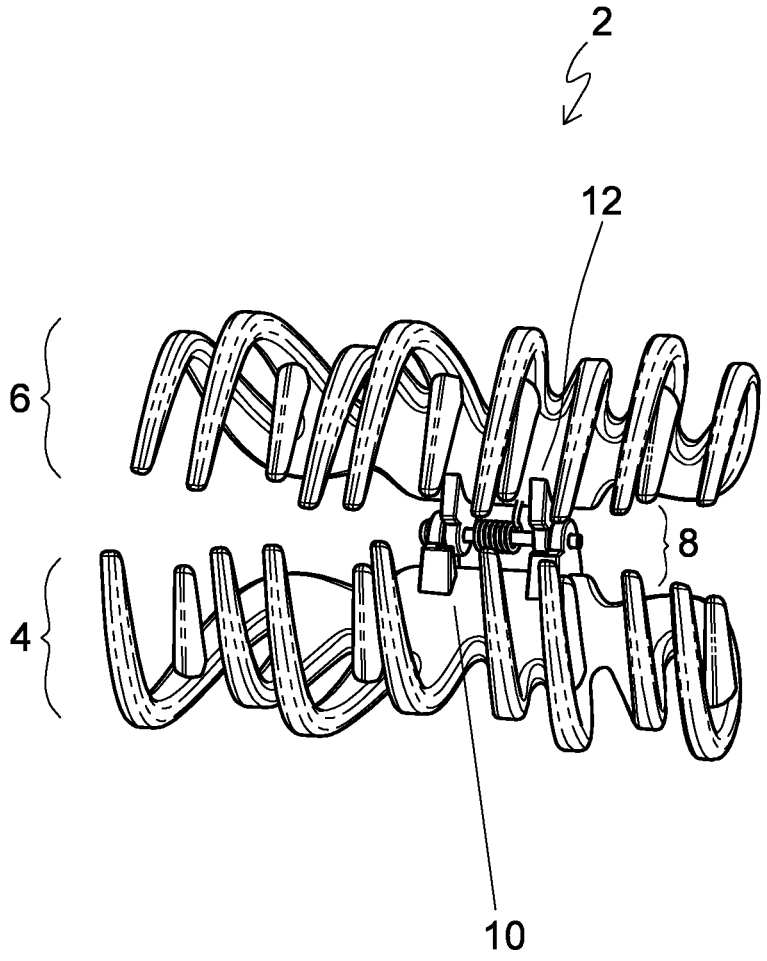
FIG. 8 is a perspective view of the hair fastener of FIG. 1 but in an open configuration.

FIG. 8 is a perspective view of the hair fastener 2 in an open configuration. The hair fastener has a first claw member 4 and a second claw member 6 pivotable connected by a hinge 8. The first claw member has a base portion 10 and a number of fingers extending from the base portion. The fingers are arranged laterally from left to right on the base portion 10. Likewise, the second claw member 6 also has a base portion 12 and a number of fingers extending from the base portion 12. The fingers of the first claw member are curved towards the second claw member 6 while the fingers of the second claw member 6 are curved towards the first claw member 4.

Figure 9:
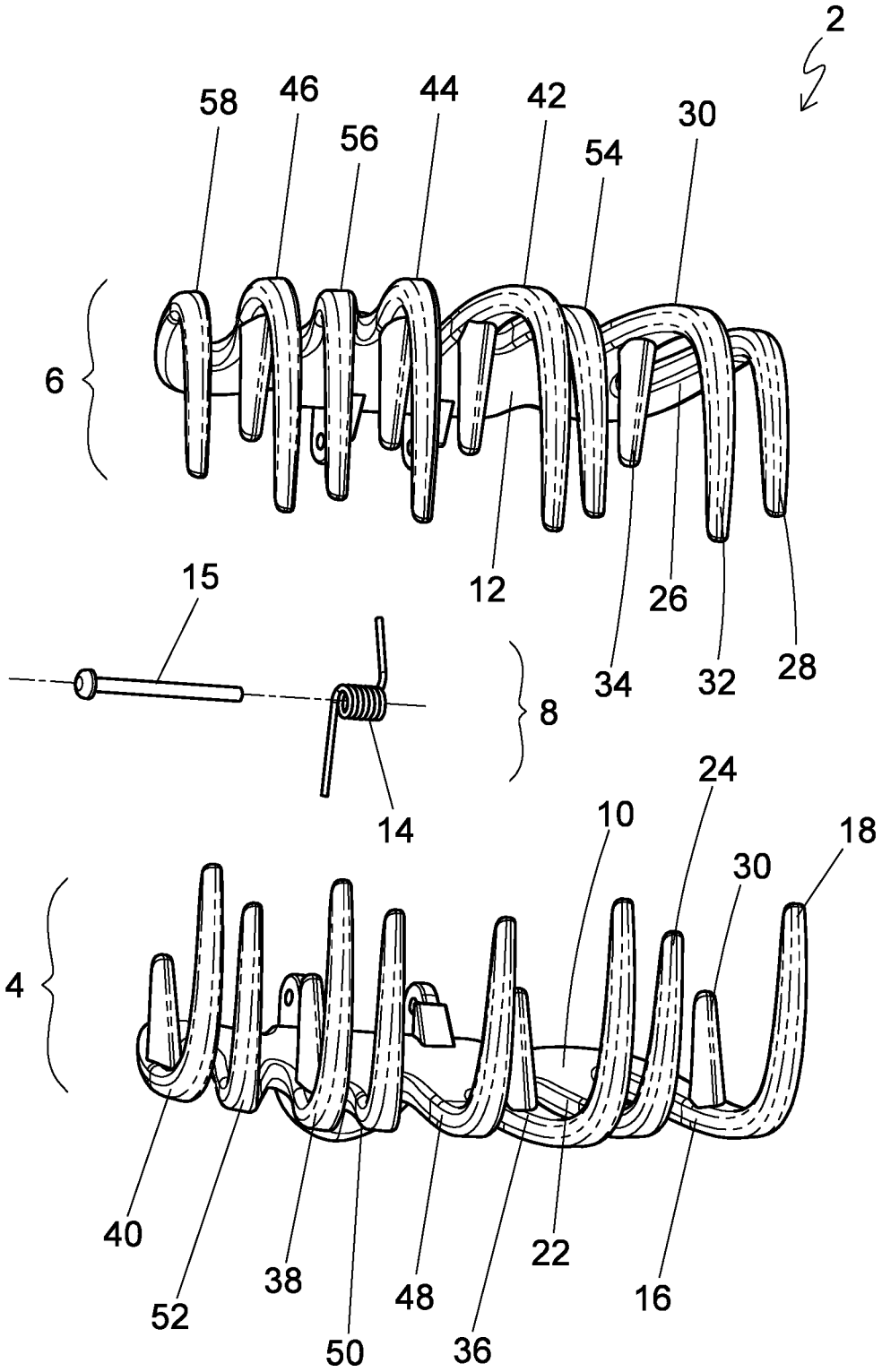
FIG. 9 is an exploded perspective view of the hair fastener of FIG. 8.
Figure 10C:
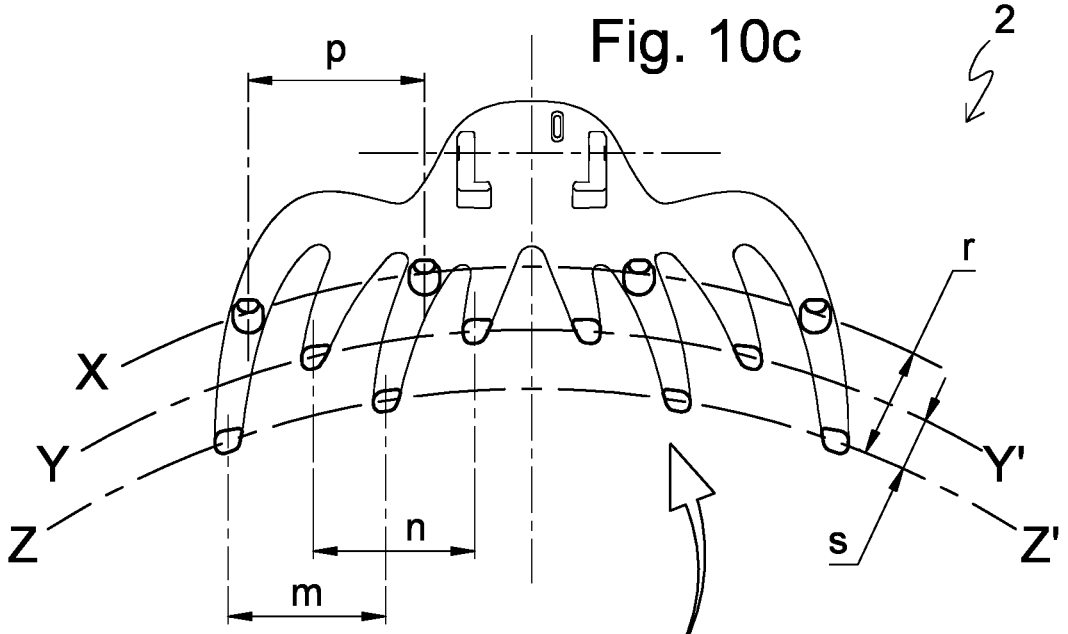
FIG. 10*a* is a front view of the fastener of FIG. 1, and FIGS. 10*b* and 10*c* are schematic diagrams showing the configuration and distribution of fingers and prongs of the hair fasteners.
Figure 10A:
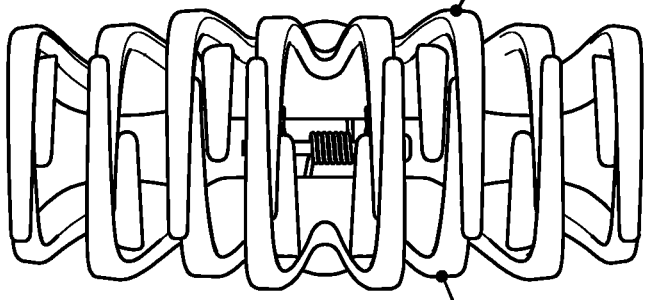
Figure 10B:
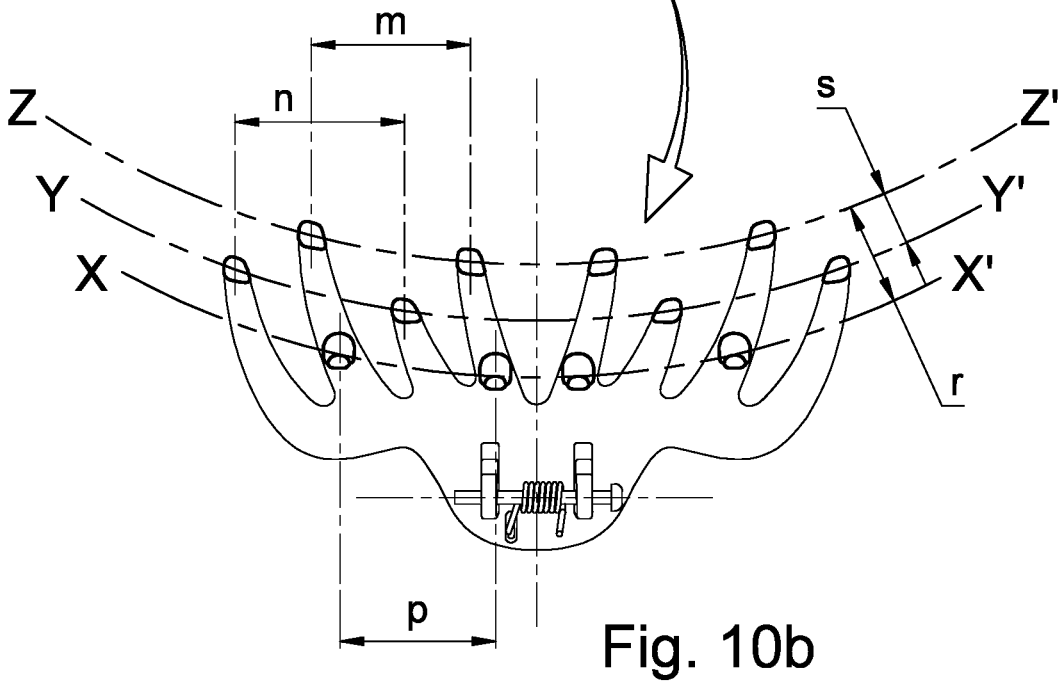

FIG. 9 is an exploded view showing the first claw member 4 and the second claw member 6 separated. The hinge 8 includes a tortional spring 14 for biasing the first and second claw members together and a pin 15 for connecting the first and second claw members 4, 6. FIG. 9 shows that the first claw member 4 has a first finger 16 provided at the farthest right end. The first finger 16 extends from the base portion 10 and forks off to transition and become two prongs, namely a first prong 18 and a second prong 20. The first prong 18 is longer and forms a distal end of the first finger 16, while the second prong 20 is shorter, extends from a mid-portion of the first finger 16 and is positioned closer to the hinge 8. In other words, the second prong 20 is positioned between the first prong 18 and the hinge 8. In this embodiment, the first claw member 4 provides four such first fingers 16, across its lateral width.

Still referring to FIG. 9, the first claw member 4 has a second finger 22 adjacent the first finger 16. Unlike the first finger 16 which has two prongs 18, 20, the second finger 22 has only one prong, i.e. third prong 24, extending therefrom. In this embodiment, the third prong 24 is shorter than the first prong 18, but longer the second prong 20.

Still referring to FIG. 9, the second claw member 6 has a third finger 26. The third finger 26 is similar to the second finger 22 in that it generally has the same configuration and it also has only one prong, i.e. a fourth prong 28.

Still referring to FIG. 9, the second claw member 6 has a fourth finger 30. The fourth finger 30 is similar to the first finger 16 in that it generally has the same configuration and it also has two prongs, namely fifth prong 32 and sixth prong 34.

In a default (closed) configuration of the hair fastener, the fourth prong 28 of the third finger 36 is positioned between the first and second prongs 18, 20, and the third prong 24 of the second finger 22 is positioned between the fifth and sixth fingers 32, 34. The second prong 20 can also be considered as positioned between the fourth prong 28 and the hinge, while the sixth prong 34 can also be considered as positioned between the fifth prong 32 and the hinge 8. Please see for example FIGS. 7 and 8.

From the above description, it can be understood that there are two types of fingers, namely a first type with two prongs extending therefrom, e.g. the fingers 16, 30, and a second type with only one prong extending therefrom, e.g. the fingers 10, 26. Since the two prongs from the first type are different in length, and the only one prong from the second type is also different in length from the two prongs of the first type, there are three different prong types and three different prong lengths. In this embodiment, the first finger type includes fingers 16, 36, 38, 40, 42, 44, and the second finger type includes fingers 22, 44, 48, 52, 28, 54, 56, 58.

In this embodiment, there is provided with four first finger type, i.e. the fingers 16, 36, 38, 40 extending from the base portion 10 of the first claw member 4, meaning there are four first fingers with a first (outer) prong from the first claw member 4. Likewise, there are four fourth fingers 30, 42, 44, 46 extending from the base portion 12 of the second claw member 6, meaning there are four fourth fingers with a fifth (outer) prong from the second claw member 6. The first prongs of the first fingers and the fifth prongs of the fourth fingers are similar in terms of their length. In a default configuration, the first prongs from the first fingers of the first claw member and the fifth prongs from the second fingers are arranged alternatively and complementarily, and define a first, or outer, prong layer, namely prong layer Z-Z'. Please see FIGS. 7 and 10*a* to 10*c*.

There is provided with four second fingers 22 extending from the base portion 10 of the first claw member, meaning there are four second fingers 22 with a third (middle) prong from the first claw member 4. Likewise, there are four third fingers 26 extending from the base portion 12 of the second claw member, meaning there are four third fingers with a fourth (middle) prong from the second claw member 6. The third prongs of the second fingers and the fourth prongs of the third fingers are similar in terms of their length. In a default configuration, the third prongs from the second fingers of the first claw member and the fourth prongs from the third fingers are arranged alternatively and complementarily, and define a second, or middle, prong layer, namely prong layer Y-Y'. Please also see FIGS. 7 and 10*a* to 10*c*.

As illustrated above, there is provided with four first fingers extending from the base portion of the first claw member, and there are four fourth fingers extending from the base portion of the second claw member. The first fingers of the first claw member are provided with four second (inner) prongs, and the fourth fingers of the second claw members are provided with four sixth (inner) prongs. The second inner prongs of the first fingers and the sixth inner prongs of the fourth fingers are similar in terms of their length. In a default configuration, the second prongs from the first fingers of the first claw member and the sixth prongs from the fourth fingers are arranged alternatively and complementarily, and define a first, or outer, prong layer, namely prong layer X-X'. Please see FIGS. 7 and 10*a* to 10*c*.

From the above illustration, it is to be understood that the hair fastener 2 is provided with fingers and prongs defining three prong layers, namely, the outer prong layer, the middle prong layer and the inner prong layer. In a broader scope, alternative embodiments according to the present invention are provided with prongs defining at least three prong layers.

Figure 11:
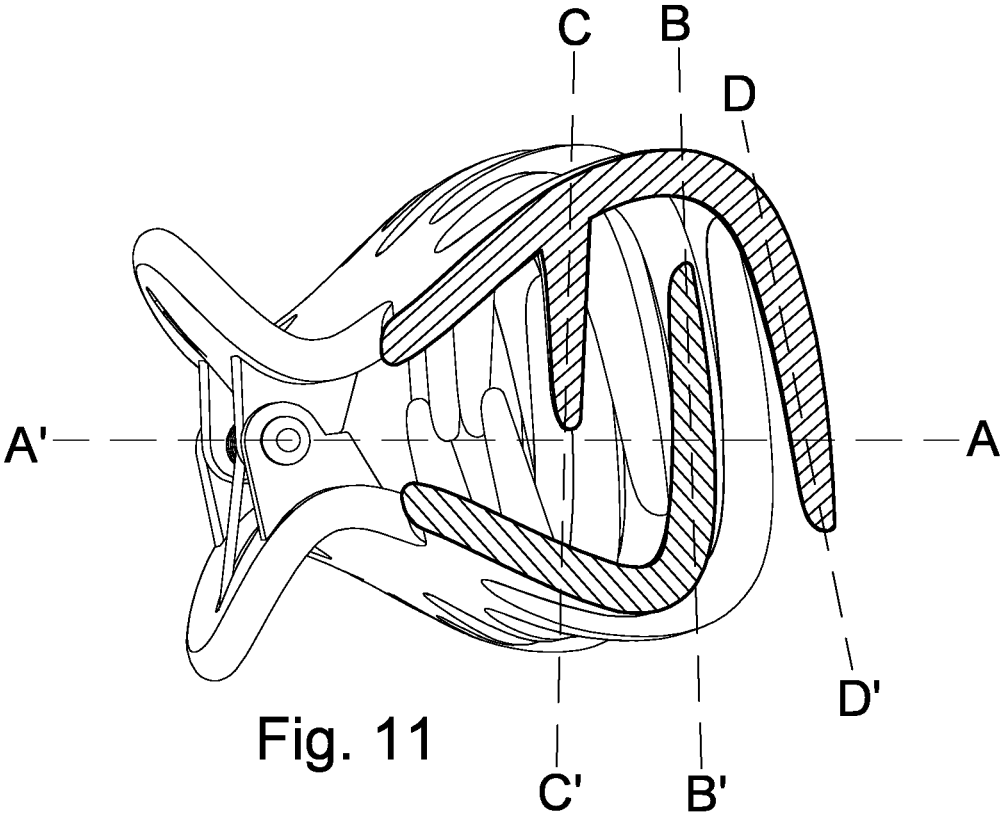
FIG. 11 is a schematic diagram of the hair fastener of FIG. 1, illustrating the configuration and position of two cooperating fingers at a lateral end of the hair fastener.
Figure 13:
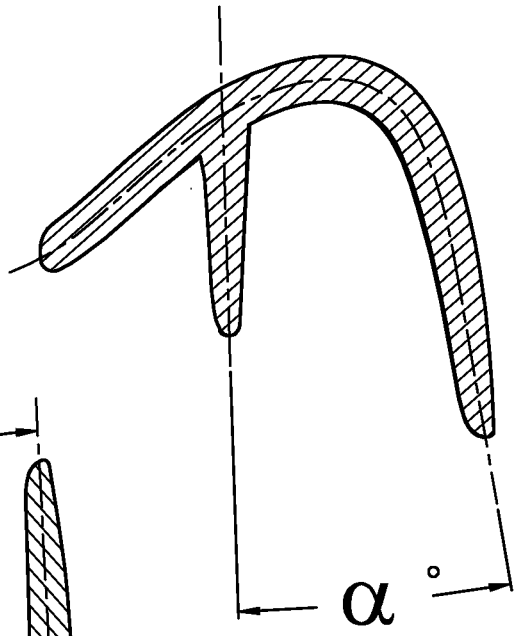
FIGS. 12 and 13 are schematic diagrams of the cooperating fingers of FIG. 11.
Figure 12:
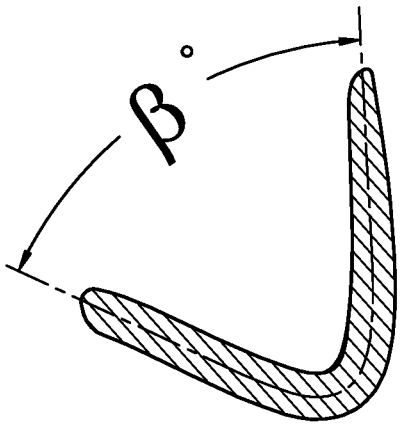
Figure 14:
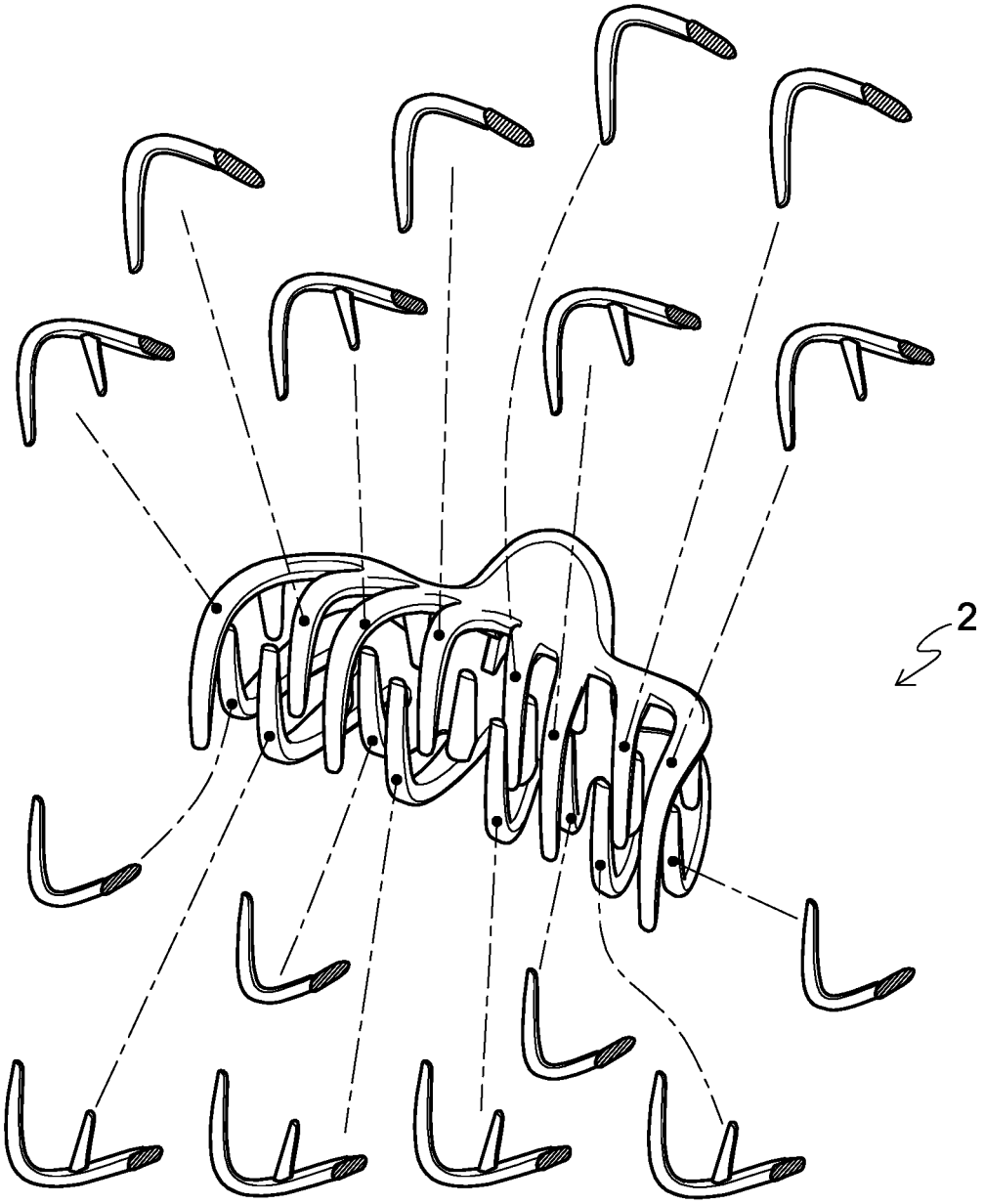
FIG. 14 is a schematic diagram illustrating the profile of all fingers of the hair fastener of FIG. 11.
Figures 15A, 15B, 15C, 15D, 15E, 16A, 16B, 16C, 16D, 16E:
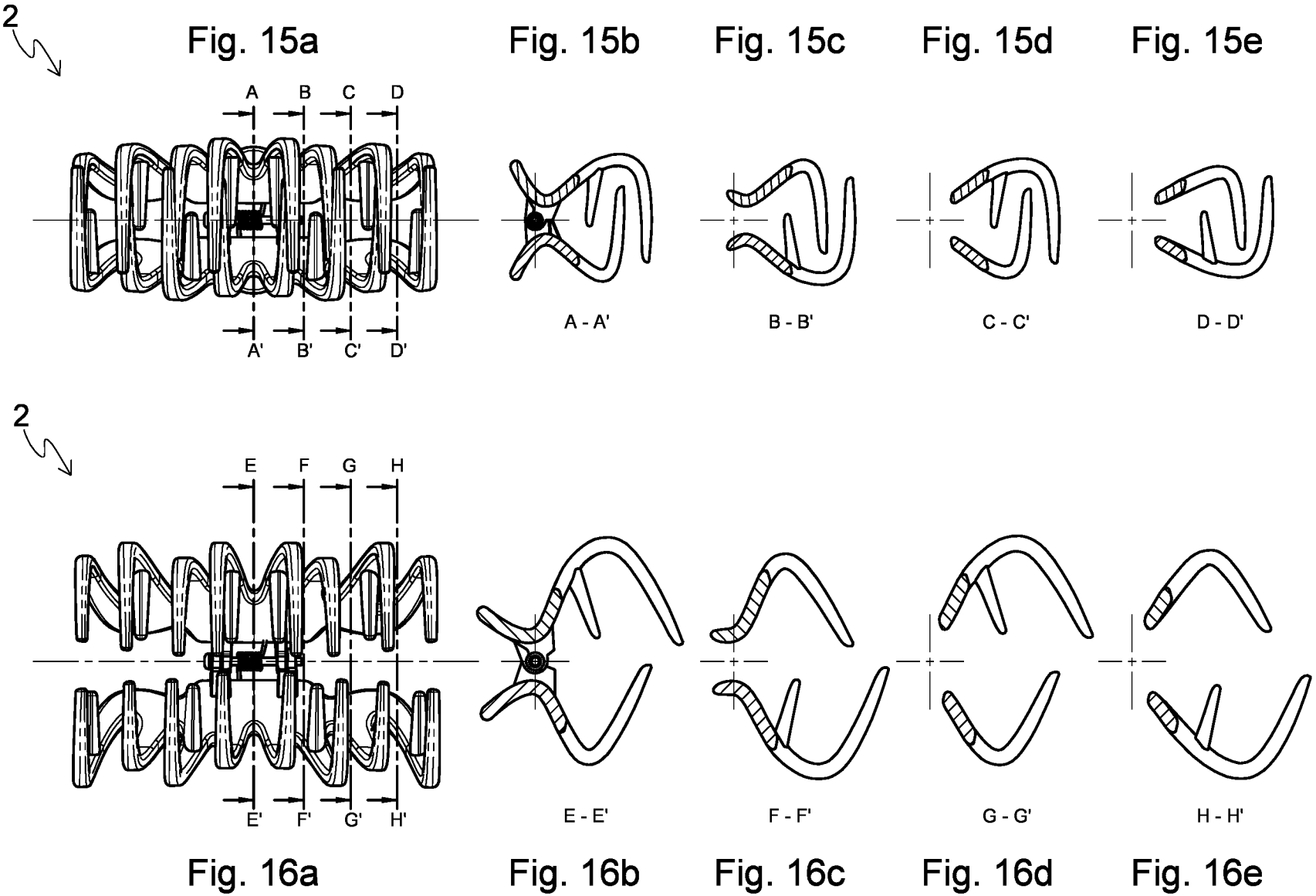
FIG. 15*a* is a front view of the hair fastener of FIG. 1 in a closed configuration.
FIGS. 15*b*-15*e* are cross section views taken at respective locations of the hair fastener of FIG. 15*a*.
FIG. 16*a* is a front view of the hair fastener of FIG. 1 in an open configuration.
FIGS. 16*b*-16*e* are cross section views taken at respective locations of the hair fastener of FIG. 16*a*.

FIGS. 11-13 illustrate the angle of orientation of the three types of prongs. FIG. 11, for example, shows that the pin 15 defining a transverse plane A-A'. Prong B defines a longitudinal axis B-B' which is perpendicular to the transverse plane A-A; prong C defines a longitudinal axis C-C' which is angled towards the hinge; and prong D defines a longitudinal axis D-D' which is angled away from the hinge. In other words, the three types of prongs have different angles of inclination. In a broader scope, alternative embodiments according to the present invention are provided with fingers and prongs defining at least three finger/prong lengths.

FIGS. 14, 15*a*-15*e* and 16*a*-16*e* summarize and illustrate the provision of two different types of fingers, three different types of prongs, three different prong lengths and prong layer, and three different prong orientations. In a broader scope, alternative embodiments according to the present invention are provided with prongs which, with respect to the transverse defined by the hinge axis, defining at least three prong angulations or orientations.

In the context of the hair fastener 2, when viewed externally, the outer prong layer generally assumes a concave surface. However, in other embodiments, the prong layers may assume a generally convex or flat layer.

Figure 17:
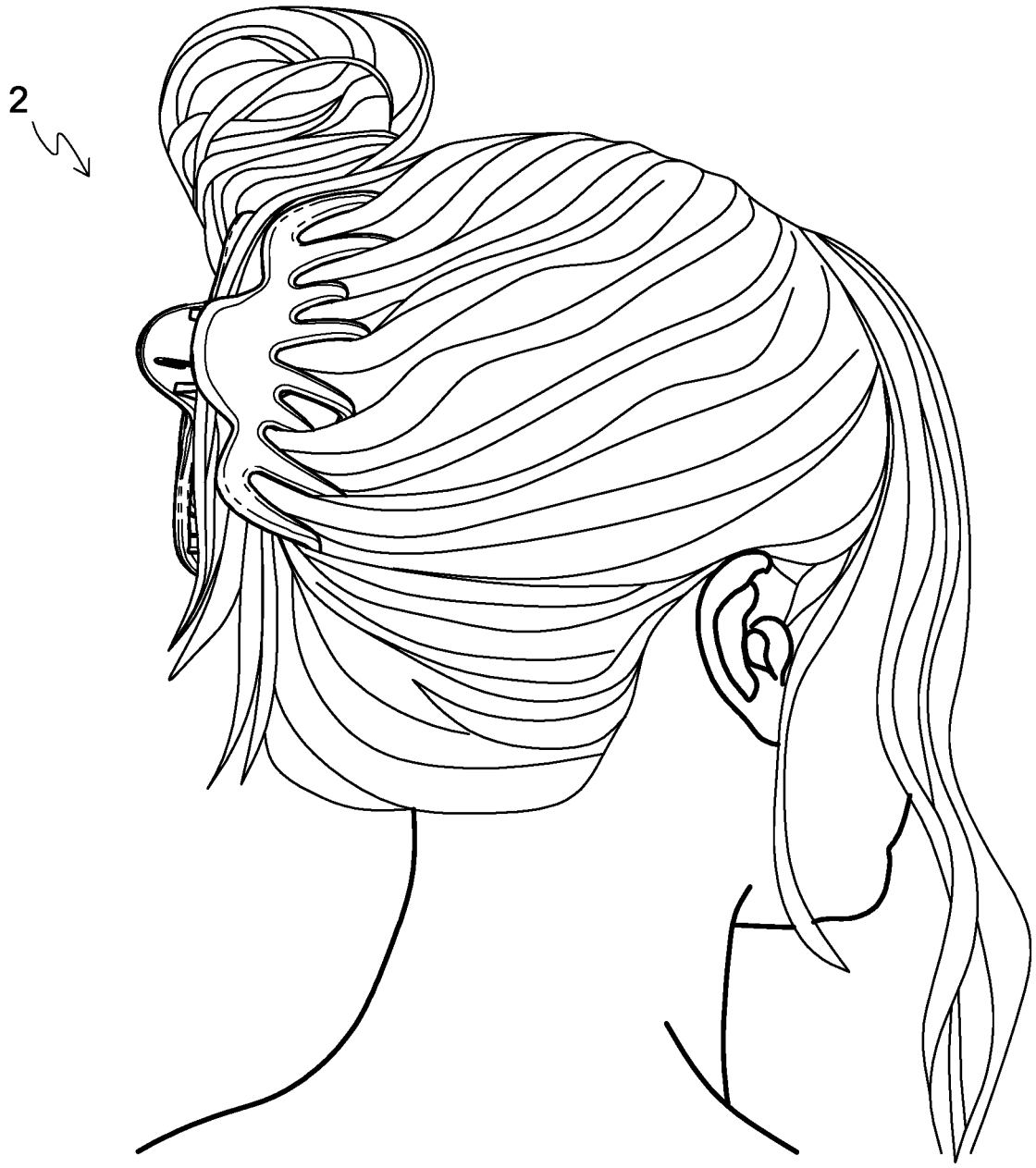
FIG. 17 is a schematic diagram showing an example of the hair fastener in use, and FIGS. 18-34 correspond to FIGS. 1 to 17, and illustrates a second embodiment of a hair fastener of the present invention.
Figure 18:
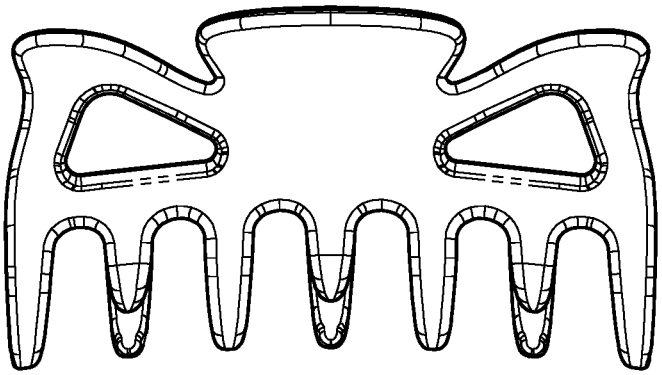
Figure 19:
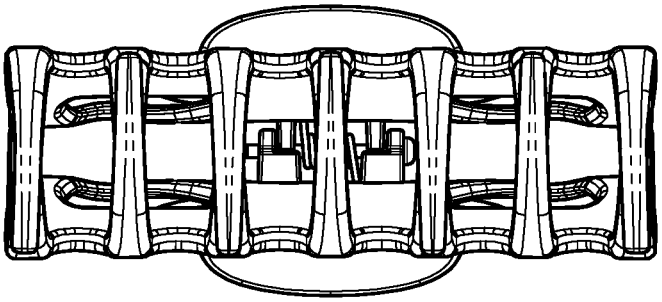
Figure 20:
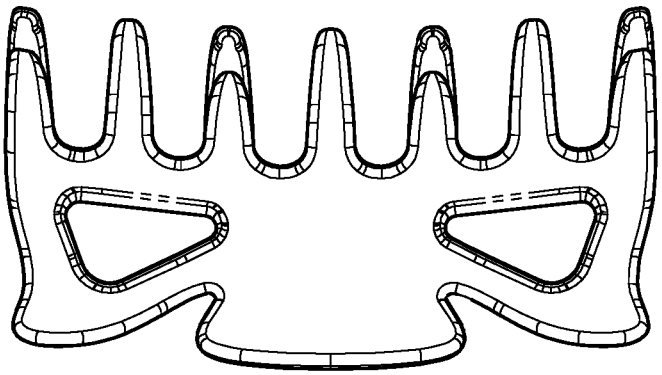
Figure 21:
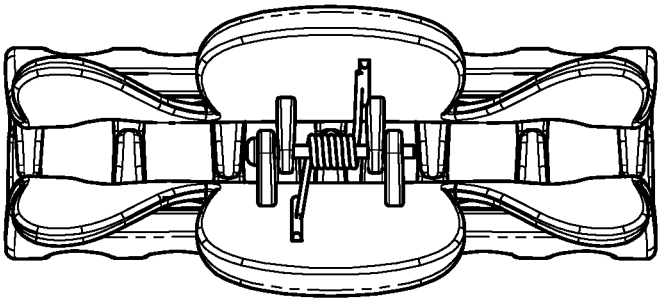
Figure 22:
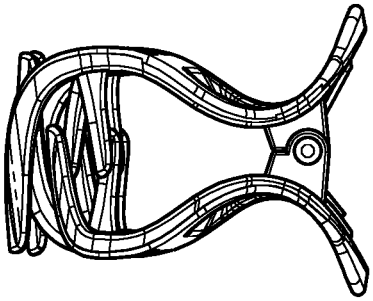
Figure 23:
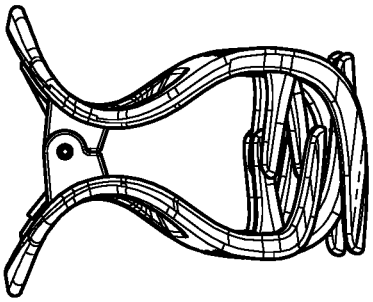
Figure 24:
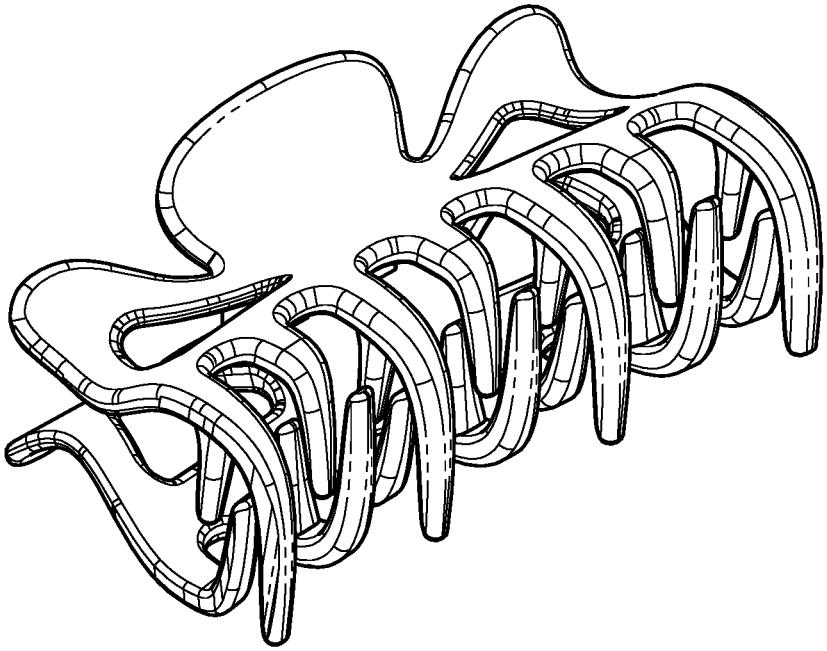
Figure 25:
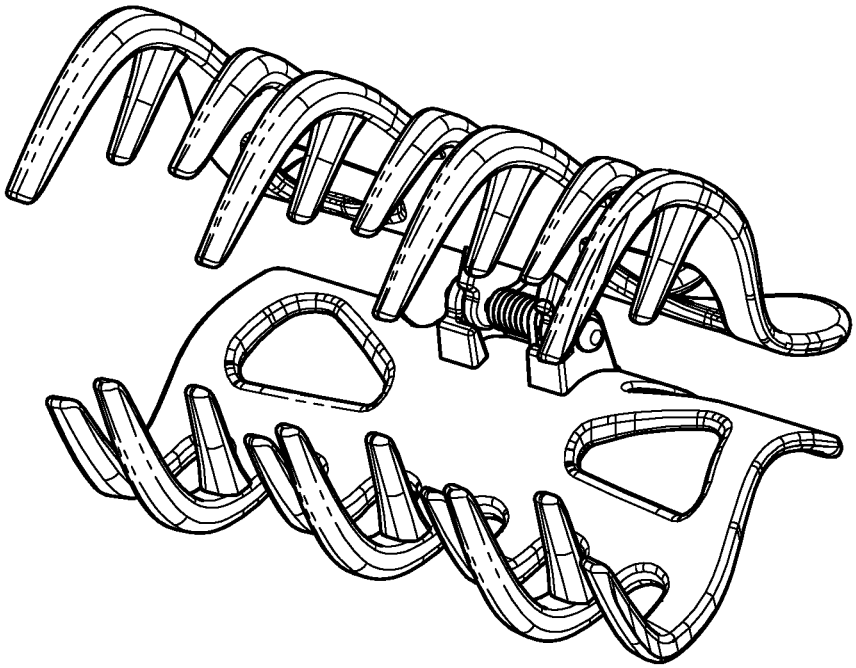
Figure 26:
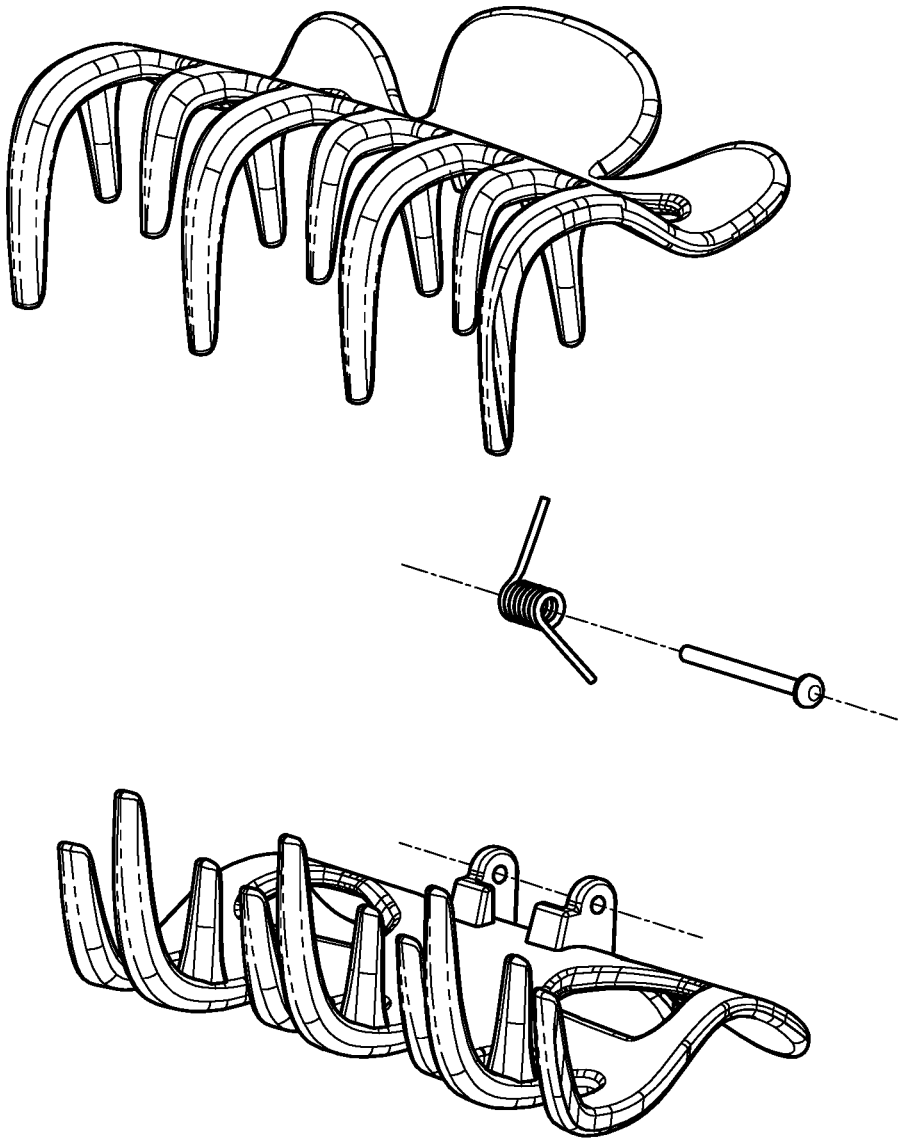
Figures 27A, 27B:
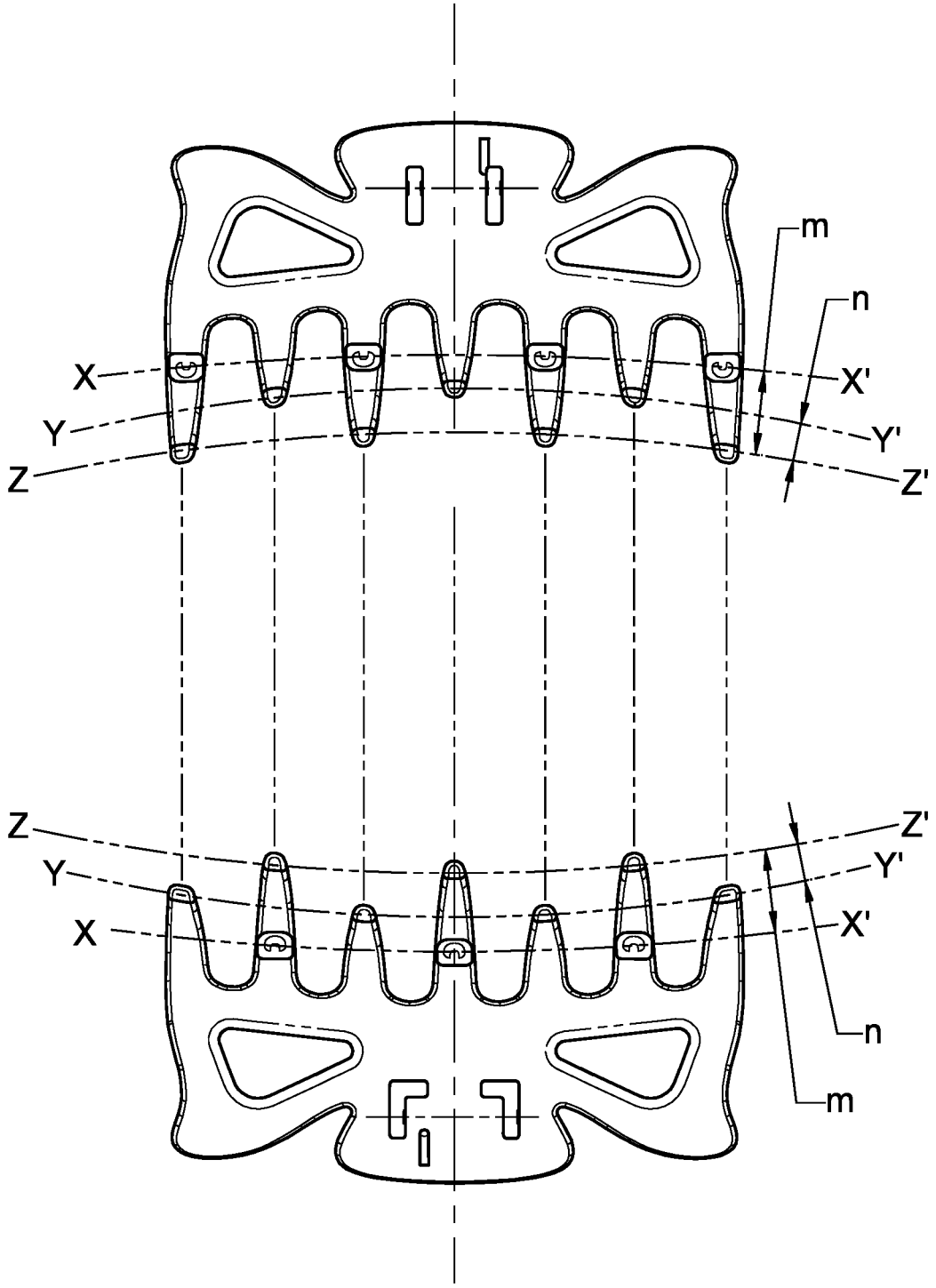
Figure 28:
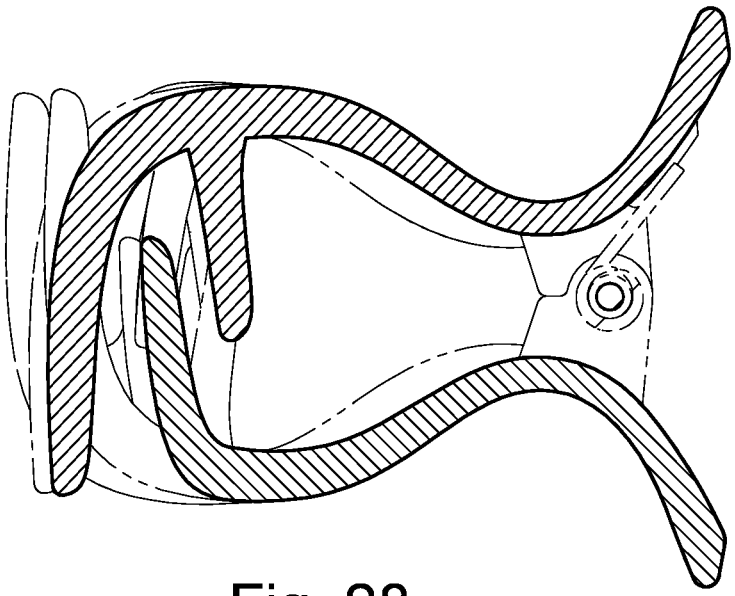
Figure 29:
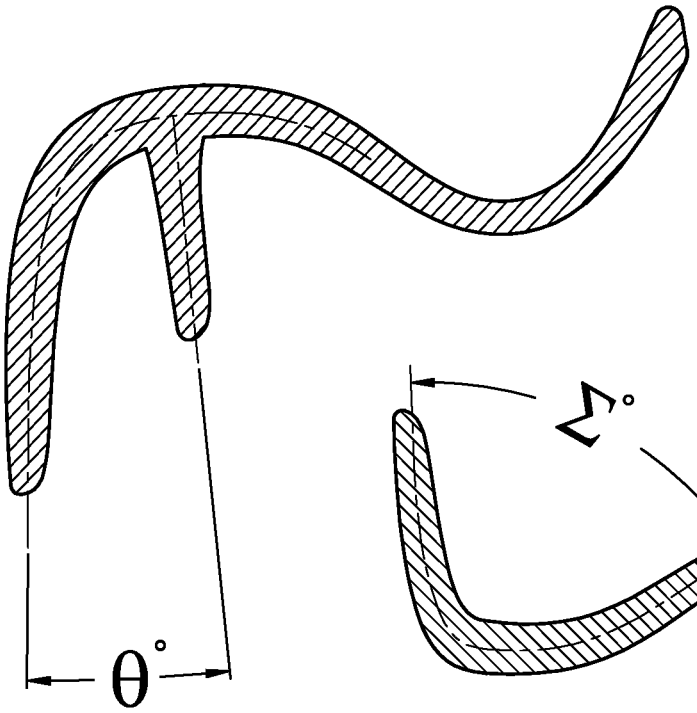
Figure 30:
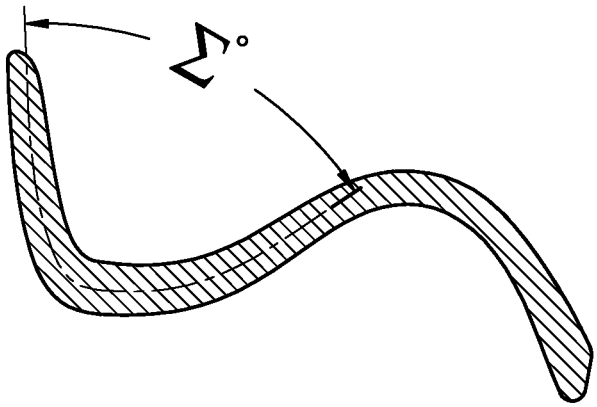
Figure 31:
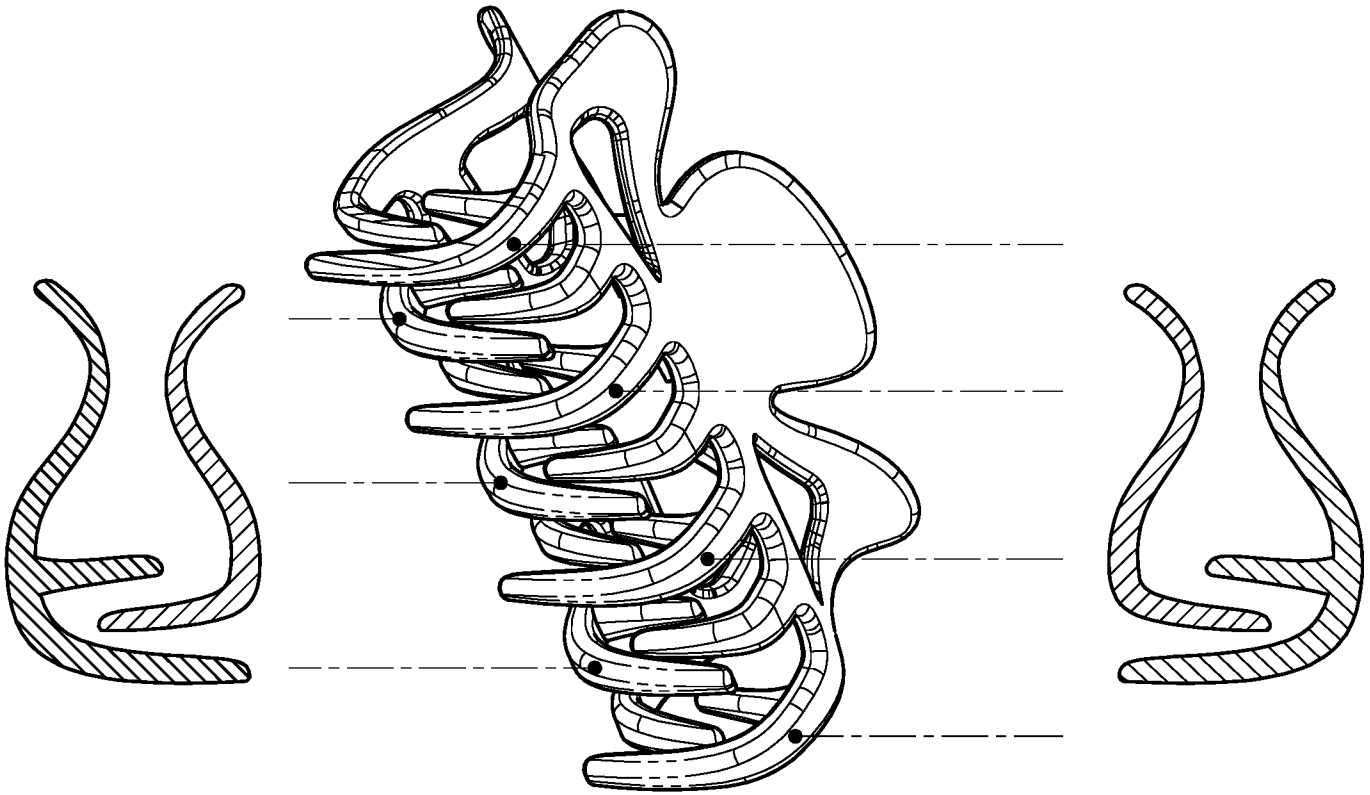
Figure 32A:
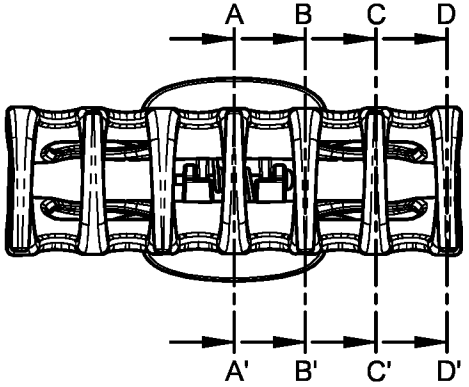
Figure 32B:
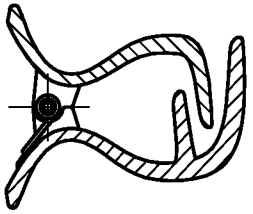
Figure 32C:
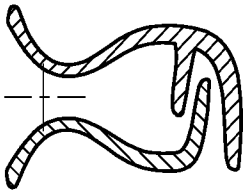
Figure 32D:
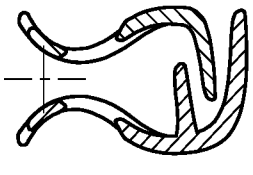
Figure 32E:
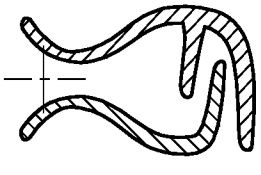
Figure 33A:
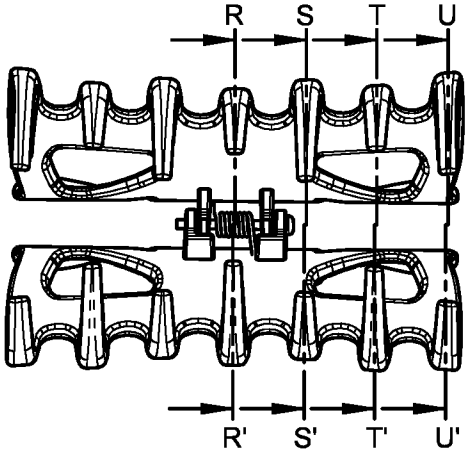
Figure 33B:
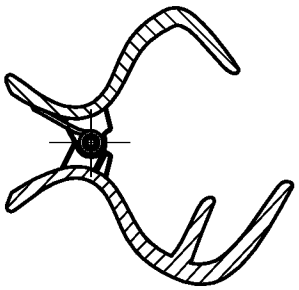
Figure 33C:
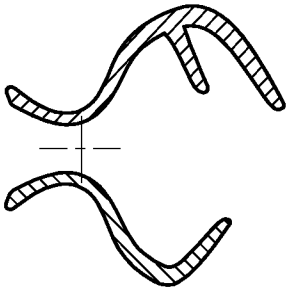
Figure 33D:
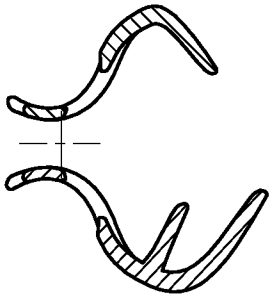
Figure 33E:
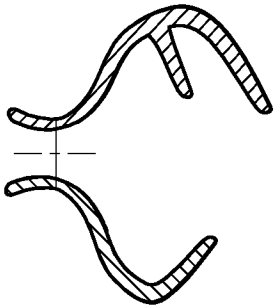
Figure 34:
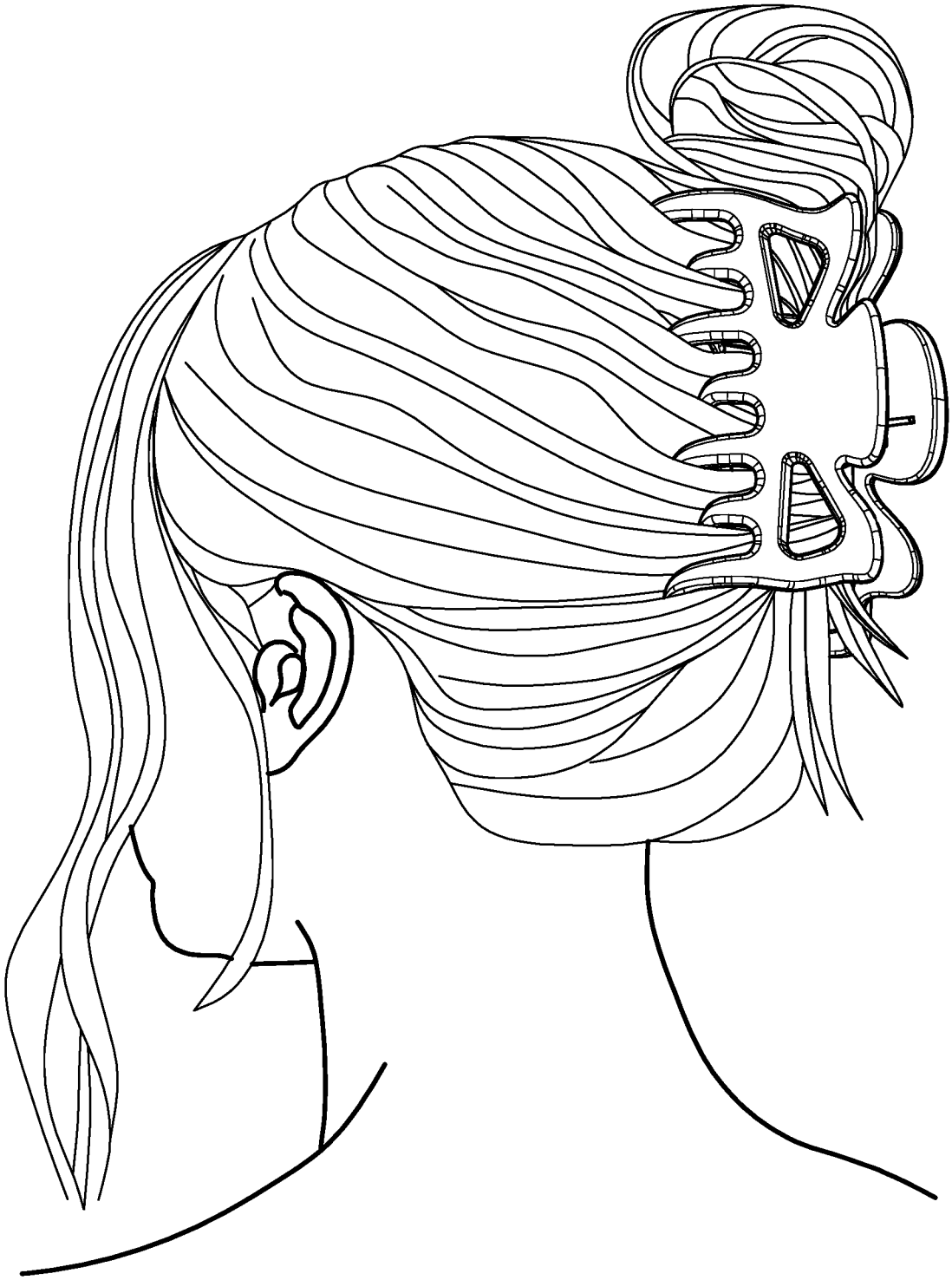

FIG. 17 illustrates the hair fastener when in use.

The provision of prongs arranged in three different layers is functionally advantageous. The outer prong layer Z-Z' at least partly serves to surround a log of hair such that the hair is accommodated in a cavity between the outer prong layer and the hinge of the hair fastener. The middle prong layer Y-Y' and the and the inner prong layer X-X' serves to allow the prongs thereof to penetrate the log of hair in order to increase the fastening capability of the hair fastener. Further, the provision of prongs with three different lengths allows them to penetrate hair to different depth which further enhances the hair holding capability. Yet further, the provision of prongs with three different orientations allows them to penetrate hair from different angles thus to further improve the hair holding power.

Figure 1:
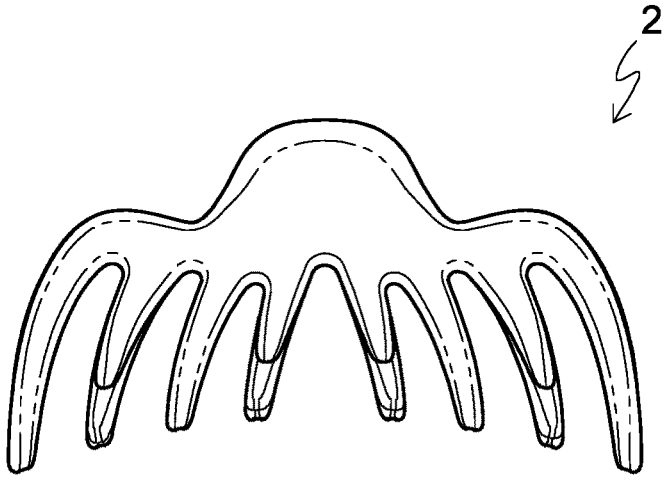
FIGS. 1 & 3 are a top view and a bottom view of a first embodiment of a hair fastener in a closed or default configuration according to the present invention.
Figure 2:
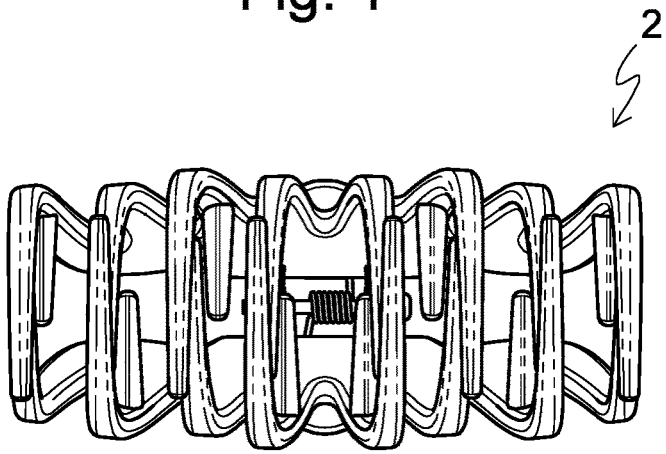
FIGS. 2 and 4 are a front view and a rear view of the hair fastener of FIG. 1, FIGS. 5 and 6 are opposite side view of the hair fastener of FIG. 1.
Figure 3:
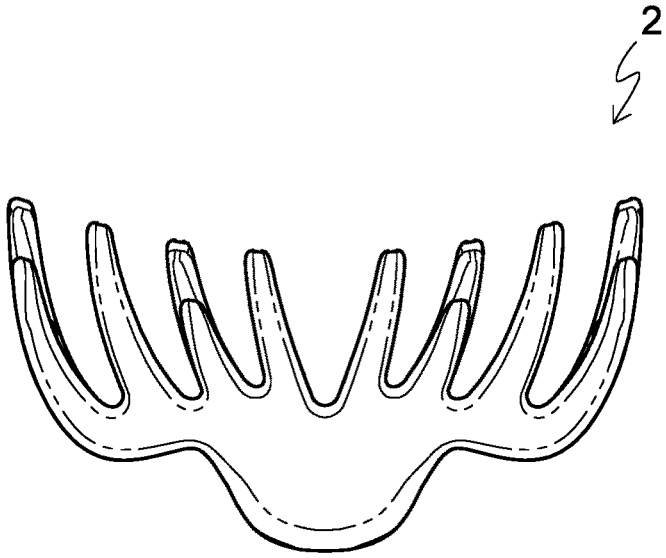
Figure 4:
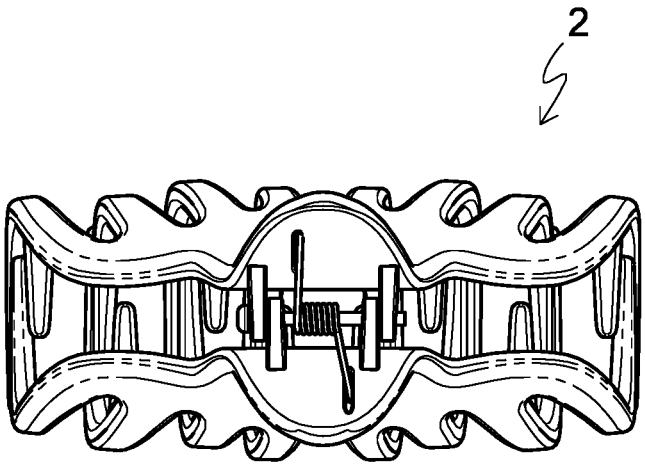
Figure 5:
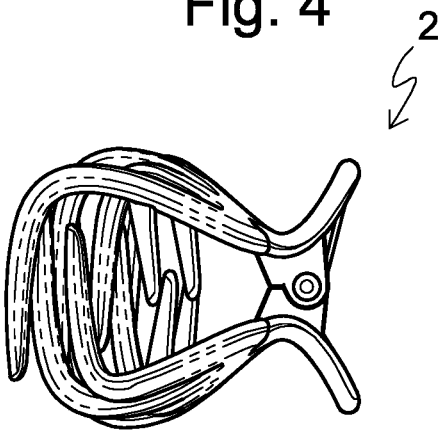
Figure 6:
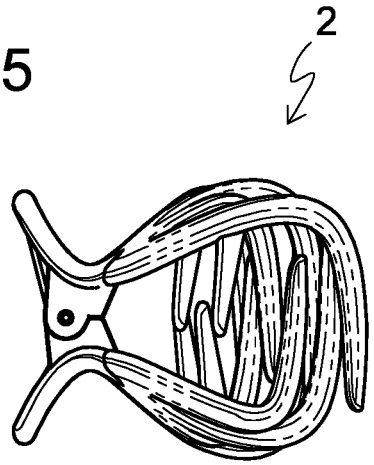

From at least FIG. 5, it is shown that, laterally, each finger layer with the fingers extending form opposite claw members are arranged in an alternating manner. The three finger layers span across a substantial height. The lateral configuration and the vertical configuration of the fingers provide a three-dimensional finger network.

FIGS. 18-34 illustrate a second embodiment of a hair fastener of the present invention. In particular, FIGS. 18, 19, 20, 21, 22, 23, 24, 25, 26, 27*a*-27*b*, 28, 29, 30, 31, 32*a*-*e*, 33*a*-*e* and 34 generally correspond to FIGS. 1, 2, 3, 4, 5, 6, 7, 8, 9, 10*b*-*c*, 11, 12, 13, 14, 15*a*-*e*, 16*a*-*e* and 17, respectively. For sake of brevity, description of the second embodiment is not repeated.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

What is claimed is:

1. A hair fastener in the form of a hair claw, comprising:

first and second claw members pivotably connected by a hinge, wherein:

the first claw member and the second claw member define a cavity there between for housing a bundle of hair in use and a transverse plane extends through the hinge between the first and second claw members bisecting the cavity, the first claw member includes at least one first finger and at least one second finger, the at least one first finger includes a first prong extending from a distal end thereof and a second prong extending from a mid-portion thereof, the at least one second finger includes a third prong extending from a distal end thereof, the second claw member includes at least one third finger and at least one fourth finger, the at least one third finger includes a fourth prong extending from a distal end thereof, the at least one fourth finger includes a fifth prong extending from a distal end thereof and a sixth prong extending from a mid-portion thereof, the first and fifth prongs are longer than the third and fourth prongs, the first and fifth prongs are longer than the second and sixth prongs, the third and fourth prongs are longer than the second and sixth prongs, the at least one first finger is arranged at a farthest lateral end of the first claw member, and wherein in a closed configuration:

the fourth prong is positioned between the first and second prongs, and the third prong is positioned between the fifth and sixth prongs, the first prong and the fifth prong define an outer prong layer, and the first and fifth prongs define a lower boundary of the cavity opposite the hinge for accommodating and securing a bundle of hair in use, the second prong and the sixth prong define an inner prong layer, and the second and sixth prongs are arranged in an upper portion of the cavity for penetrating into and securing the bundle of hair, where free end portions of the second and sixth prongs occupy a portion of the center of the cavity where the transverse plane extends, the third prong and the fourth prong define a middle prong layer, and the third and fourth prongs extend into the cavity for penetrating into and securing the bundle of hair in use.

2. A hair fastener as claimed in claim 1, wherein the first and fifth prongs are of a first length, the second and sixth prongs are of a second length, and the third and fourth prongs are of a third length, and the first, second and third lengths are different.

3. A hair fastener as claimed in claim 1, wherein the first, second and third prongs are pointing towards the second claw member, and the fourth, fifth and sixth prongs are pointing towards to the first claw member.

4. A hair fastener as claimed in claim 1, wherein the at least one first finger comprises four first fingers, the at least one second finger comprises four second fingers, the at least one third finger comprises four third fingers and the at least one fourth finger comprises four fourth fingers.

5. A hair fastener as claimed in claim 1, wherein the at least one first finger comprises a plurality of first fingers, the at least one second finger comprises a plurality of second fingers, the at least one third finger comprises a plurality of third fingers, and the at least one fourth finger comprises a plurality of fourth fingers, wherein the first prongs from the plurality of first fingers and the fifth prongs from the plurality of fourth fingers are arranged in a cooperating and complementary manner, the third prongs from the plurality of the second fingers and the fourth prongs from the plurality of third fingers are arranged in a cooperating and complementary manner, and the second prongs from the plurality of first fingers and the sixth prongs from the plurality of the fourth fingers are arranged in a cooperating and complementary manner.

6. A hair fastener as claimed in claim 1, wherein the first and second prongs extend in a diverging configuration, and the fifth and sixth prongs extend in a diverging configuration.

7. A hair fastener as claimed in claim 1, wherein the hinge comprises a torsional spring and a pin defining an axis about which the first claw member and the second claw member pivot, wherein:

the axis extends through the transverse plane, the first and fifth prongs are angled away from the hinge with respect to the transverse plane, the third and fourth prongs are arranged perpendicularly to the transverse plane, and the second and sixth prongs are angled towards the hinge with respect to the transverse plane.

8. A hair fastener in the form of a hair claw, comprising: a first claw member pivotably connected to a second claw member via a hinge, wherein:

the first claw member and the second claw member define a first cavity therebetween for housing a bundle of hair in use, and a transverse plane extends through the hinge between the first and second claw members bisecting the cavity, the first claw member is provided with a plurality of first prongs and the second claw member is provided with a plurality of fifth prongs which together define an outer prong layer, the first claw member is provided with a plurality of third prongs and the second claw member is provided with a plurality of fourth prongs which together define a middle prong layer, and the first claw member is provided with a plurality of second prongs and the second claw member is provided with a plurality of sixth prongs which together define a inner prong layer, the plurality of first prongs and the plurality of fifth prongs are of a first length, the plurality of third prongs and the plurality of fourth prongs are of the second length, and the plurality of second prongs and the plurality of sixth prongs are of a third length, wherein the third length is smaller than the first length, and the third length is smaller than the second length, the plurality of first prongs, the prongs of second prongs, and the plurality of third prongs from the first claw member point towards the second claw member, and the plurality of fourth prongs, the plurality of fifth prongs and the plurality of sixth prongs from the second claw member point towards the first claw member, the plurality of the first prongs and the plurality of the fifth prongs are arranged in a cooperating and complementary manner, the plurality of the first prongs and the plurality of the fifth prongs together define a lower boundary of the cavity opposite the hinge for surrounding and accommodating a bundle of hair in use, the plurality of third prongs and the plurality of fourth prongs are arranged in a cooperating and complementary manner, the plurality of the third prongs are positioned between the respective fifth and sixth prongs, the plurality of the fourth prongs are positioned between the respective first and second prongs, and the plurality of third prongs and the plurality of fourth prongs are positioned to penetrate into and secure a bundle of hair in use, the plurality of second prongs and the plurality of sixth prongs are arranged in a cooperating and complementary manner, and are positioned to penetrate into and secure the bundle of hair in use, wherein in a closed configuration, free end portions of the second and sixth prongs occupy a portion of the center of the cavity where the transverse plane extends.

9. A hair fastener as claimed in claim 8, wherein each of the plurality of second prongs are positioned between a respective one of the plurality of first prongs and the hinge, and each of the plurality of sixth prongs are positioned between a respective one of the plurality of fifth prongs and the hinge.

* * * * *